US006185387B1

(12) United States Patent
Ohzeki et al.

(10) Patent No.: US 6,185,387 B1
(45) **Date of Patent: *Feb. 6, 2001**

(54) IMAGE FORMING APPARATUS

(75) Inventors: Yukihiro Ohzeki, Yokohama; Katsuhiro Sakaizawa, Numazu, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/075,210

(22) Filed: May 11, 1998

(30) Foreign Application Priority Data

May 9, 1997 (JP) ..... 9-119825
Jul. 9, 1997 (JP) ..... 9-183938

(51) Int. Cl.[7] ..... G03G 15/00; G03G 15/06; G03G 15/16

(52) U.S. Cl. ..... 399/66; 399/19; 399/46; 399/76; 399/100; 399/101; 399/149

(58) Field of Search ..... 399/18, 44, 45, 399/46, 50, 53, 55, 66, 76, 77, 127, 100, 101, 149, 150, 19, 21

(56) References Cited

U.S. PATENT DOCUMENTS

| | | | | |
|---|---|---|---|---|
| 5,034,777 | | 7/1991 | Ohzeki et al. | 399/66 |
| 5,132,738 | * | 7/1992 | Nakamura et al. | 399/101 |
| 5,151,736 | * | 9/1992 | Ohzeki et al. | 399/66 |
| 5,294,964 | * | 3/1994 | Oshiumi | 399/150 |
| 5,321,481 | * | 6/1994 | Mathers | 399/76 X |
| 5,339,144 | * | 8/1994 | Nakai et al. | 399/66 |
| 5,404,213 | * | 4/1995 | Okano et al. | 399/127 |
| 5,420,668 | * | 5/1995 | Okano | 399/66 X |
| 5,568,232 | * | 10/1996 | Kashihara | 399/50 X |
| 5,692,232 | * | 11/1997 | Okano et al. | 399/53 |
| 5,740,493 | * | 4/1998 | Otaki et al. | 399/55 X |
| 5,878,312 | * | 3/1999 | Hisada | 399/149 |

FOREIGN PATENT DOCUMENTS

| | | |
|---|---|---|
| 2-123385 | 5/1990 | (JP) . |
| 5-2289 | 1/1993 | (JP) . |
| 5-313431 | 11/1993 | (JP) . |
| 8-254899 | 10/1996 | (JP) . |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member; a charging member for charging a surface of the image bearing member while contacting thereto with a predetermined voltage applied to the charging member; exposure member for exposing the surface of the image bearing member to form an electrostatic latent image; a toner carrying member contacted to the image bearing member with a predetermined voltage applied to the toner carrying member to visualize the electrostatic latent image into a toner image with toner carried thereon; an image transfer member for urging a transfer material to contact the transfer material to the image bearing member with a predetermined voltage applied to the image transfer member to transfer the toner image onto the transfer material; a device for applying the predetermined voltages to the charging member, the toner carrying member and the transfer member; and a controller for controlling the device that applies the predetermined voltage, the controller being operable in an operation mode for applying the predetermined voltage Vc to the charging member, the predetermined voltage Vdiv to the toner carrying member and the predetermined voltage Vtr to the transfer member, with the following satisfied:

(1) Vc, Vdiv and Vtr have polarities the same as that of the toner:

(2) $|V1|>|Vdiv|$, where V1 is a surface potential of the image bearing member charged by the charging means: and (3) $|V1|>|V2|$, where V2 is a surface potential of the image bearing member charged by voltage Vtr.

44 Claims, 8 Drawing Sheets

IMAGE FORMING APPARATUS

FIELD OF THE INVENTION AND RELATED ART

The present invention relates to image forming apparatuses such as electrophotographic recording apparatuses, electrostatic recording apparatuses, or the like, which employ an electrophotographic method. In particular, it relates to image forming apparatuses which employ a cleanerless system. In cleanerless type image forming apparatuses, the toner particles remaining on a photosensitive member are recovered during a developing step, and therefore, the toner particles remaining on the photosensitive member can be efficiently recovered even when an operational error such as a paper jam occurs during an image forming operation.

There are various image forming apparatuses which employ an electrophotographic method. For example, to begin with, there are copying machines, and also, there are page printers such as laser beam printers; and plain paper facsimile machines which employ laser beam printers or the like. In recent years, these image forming apparatuses have suddenly become very popular.

Lately, cleanerless type image forming apparatuses have become more popular than the others. In these apparatuses, the cleaning apparatus, which is one of the essential components of a conventional electrophotographic image forming apparatus, has been eliminated to reduce the size and cost of the apparatus.

In these cleanerless type image forming apparatuses, a developing apparatus carries out the cleaning process for removing the toner particles remaining on a photosensitive drum after image transfer, in addition to its principal duty, that is, the developing process. In the past, in order to improve the cleaning efficiency of the developing apparatus, and also in order to prevent the production of substandard images traceable to exposure problems caused by the residual toner particles, a member such as an electrically conductive brush or an electrically conductive roller has been placed in contact with the peripheral surface of a photosensitive drum. For example, Japanese Laid-Open Patent Application Nos. 5-2289 and 5-313431, respectively and the like disclose such an arrangement, in which an electrically conductive brush is placed in contact with the peripheral surface of a photosensitive drum, on the area between the transferring means and the primary charging means. Thus, the actual structure of a typical conventional cleanerless system will be described below, with reference to these arrangements.

The image forming apparatus in FIG. 9 comprises: a photosensitive drum 100 which is rotated in the direction indicated by an arrow mark X; a charging device 101 for uniformly charging the peripheral surface of the photosensitive drum 100; an exposing device 102 for exposing the charged peripheral surface of the photosensitive drum 100 so that image data are written in the form of an electrostatic latent image; a developing device 103 for developing the electrostatic latent image into a toner image (visible image) by applying toner to the electrostatic latent image; a charging device 104 for transferring the toner image onto transfer medium; a lamp 105 for discharging the peripheral surface of the photosensitive drum 100 by exposing it, after toner image transfer; and an electrically conductive brush 106 which gently scratches the peripheral surface of the photosensitive drum 100 so that the toner particles remaining, unaffected by the transfer process, on the peripheral surface of the photosensitive drum 100 are dispersed. The developing device 103 carries out a cleaning process, in addition to a developing process, that is, the principal process. In this cleaning process, the toner particles dispersed on the peripheral surface of the photosensitive drum 100 are recovered by the electrically conductive brush 106.

A switch 107 makes it possible to choose between applying positive voltage to the electrically conductive brush 106 and grounding the electrically conductive brush 106. A switch 108 makes it possible to choose between applying positive voltage to the transfer charger 104 and grounding the transfer charger 104. These switches 107 and 108 are connected to a CPU 110 through an I/O port 109, and are controlled by the CPU 110 which carries out the programs stored in a ROM 111. At a proper time, the CPU 110 applies positive voltage of a predetermined magnitude to the transfer charger 104 by controlling the switch 108, so that the peripheral surface of the photosensitive drum 100 is charged to positive polarity. At the same time, it controls the switch 107 to ground the electrically conductive brush 106, so that the toner particles accumulated in the electrically conductive brush 106 are discharged onto the photosensitive drum 100.

The above described structure of the conventional cleanerless system is effective from the standpoint of assuring that the residual toner particles are temporarily recovered by the electrically conductive brush 106.

However, it absolute terms, the electrically conductive brush 106 is a component unnecessary for an image forming operation, as is disclosed in Japanese Laid-Open Patent Application No. 8-254899. More specifically speaking, lately, toners composed of spherical toner particles, which are produced by polymerization, have been commercialized, being available in some areas, and the transfer efficiency for this type of toner is extremely high (98% or higher) compared to the transfer efficiency for the conventional toners produced by pulverization; the residual toner particles are virtually nonexistent. In this kind of environment, providing an image forming apparatus with the electrically conductive brush 106, the discharger lamp 105, and the like contribute very little to the improvement of the apparatus, but it does increase apparatus cost, canceling the beneficial effects, such as cost reduction or size reduction, of the cleanerless system. In other words, the conventional cleanerless systems are effective in terms of environmental concerns (they do not produce waste toner), but in terms of other concerns, they have little merit. The only virtue of these conventional cleanerless systems (electrically conductive brush 106 and the like) is that they are very effective when an operational error such as a paper jam occurs during an image forming operation.

Further, the technology disclosed in Japanese Laid-Open Patent Application No. 8-254899 is compatible only with the systems which employ a noncontact type primary charger and a noncontact type transfer charger (charger with the structure depicted in FIG. 9), that is, the corona based charger. In other words, they are not compatible with the systems which employ a contact type primary charger and a contact type transfer charger, that is, the systems which have been becoming popular lately. This is due to the following reason. In the case of a primary charger or a transfer charger of the contact type, the charging member is placed in contact with the peripheral surface of a photosensitive drum, and therefore, the charging member becomes contaminated with toner before an exposing process, and as the charging member is contaminated, the photosensitive drum cannot be uniformly charged to a predetermined potential level, which contributes to further contamination of the peripheral surface of the photosensitive drum by toner; the contamination of the photosensitive drum by toner becomes extreme.

As is evident from the above description, the technologies prior to the present invention have failed to take advantage of the primary merits (size reduction, cost reduction, and environmental superiority) of the cleanerless system.

SUMMARY OF THE INVENTION

The object of the present invention is to provide a cleanerless image forming apparatus, that is, an image forming apparatus which does not employ a cleaning assisting member such as an electrically conductive brush, and therefore, is compatible with a primary charger and a transfer charger which are based on a contact type charging system.

According to an aspect of the present invention which accomplishes the above object, an image forming apparatus comprises: an image bearing member with a photoconductive surface; a charging member which is placed in contact with the image bearing member, and charges the surface of the image bearing member as voltage of a predetermined magnitude is applied to the charging member; an illuminating means which illuminates the surface of the image bearing member charged by the charging member, to form an electrostatic latent image on the surface; a toner carrying member which is placed in contact with the image bearing member, and forms a toner image, that is, visualizes the electrostatic latent image formed on the peripheral surface of the image bearing member, with the use of toner, as voltage of a predetermined magnitude is applied to the toner carrying member; an image transferring member which is placed in contact with the image bearing member, and transfers the toner image on the image bearing member onto recording medium delivered to the interface, or the contact nip, between the image bearing member and the transferring member; a voltage applying means which applies voltage of a different magnitude to the charging member, to the toner carrying member, and to the image transferring member; a controlling means which is capable of carrying out the following three different modes to properly control the voltages applied to the charging member, the toner carrying member, and the image transferring member:

mode 1: Polarities of Vc, Vdiv, and Vtr are the same as the polarity to which toner becomes charged;

mode 2: The absolute values of the V1 and Vdiv satisfies the following relation: $|V1|>|Vdiv|$;

mode 3: The absolute values of the V1 and V2 satisfies the following relation: $|V1|>|V2|$;

wherein

Vc: voltage charged to charging member,

Vdiv: voltage charged to toner carrying member,

Vtr: voltage charged to image transferring member,

V1: potential level of portion of surface of image bearing member charged by Vc, and

V2: potential level of portion of surface of image bearing member charged by Vtr.

According to another aspect of the present invention which accomplishes the above described object, an image forming apparatus comprises an image bearing member; a charging member which is placed in contact with the image bearing member, and uniformly charges the surface of the image bearing member to a predetermined potential level; an exposing means which forms an electrostatic latent image on the image bearing member surface by illuminating the image bearing member surface with light; a developing means which visualizes the electrostatic latent image into a toner image with the use of toner; an image transferring member which is placed in contact with the image bearing member, and transfers the toner image onto recording medium; a voltage applying means which applies a different specific voltage to the charging means, to the developing means, and to the image transferring means; a controlling means which controls the voltage applying means; and a fixing means which thermally fixes the toner image on the recording medium, wherein the controlling means is capable of carrying out a plurality of sequences for controlling the voltage applying means, and selects a proper sequence from among the plurality of control sequences, in response to the output from a means for detecting the operational status of the image forming apparatus during an image forming operation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the embodiments of the present invention will be described with reference to the drawings.

Embodiment 1

The image forming apparatus in this embodiment is a cleanerless apparatus, and uses nonmagnetic single component toner composed of spherical toner particles formed by polymerization. One of the specific characteristics of this apparatus in that the toner particles (hereinafter, "residual toner particles") remaining on the peripheral surface of a photosensitive drum 1 are efficiently returned to an image developing roller (hereinafter, "development roller") by optimally controlling the voltage applied to the image transferring roller 4 (hereinafter, "transfer roller") and the like. In this case, the residual toner particles include such toner particles that have adhered to the peripheral surface of the photosensitive drum 1 during a paper jam or the occurrences of the like problems.

In the case of an image forming apparatus such as the one in this embodiment, the production of substandard images traceable to the contamination of the charger roller 2 by the residual toner, and/or the blocking of the exposing light by the residual toner seldom occur during a normal image forming operation. It is during a so-called paper jam when the residual toner particles on the surface of the photosensitive drum 1 adversely affect the image forming operation, and this embodiment is effective to recover the residual toner for which a paper jam or the like is responsible.

Figure 1:
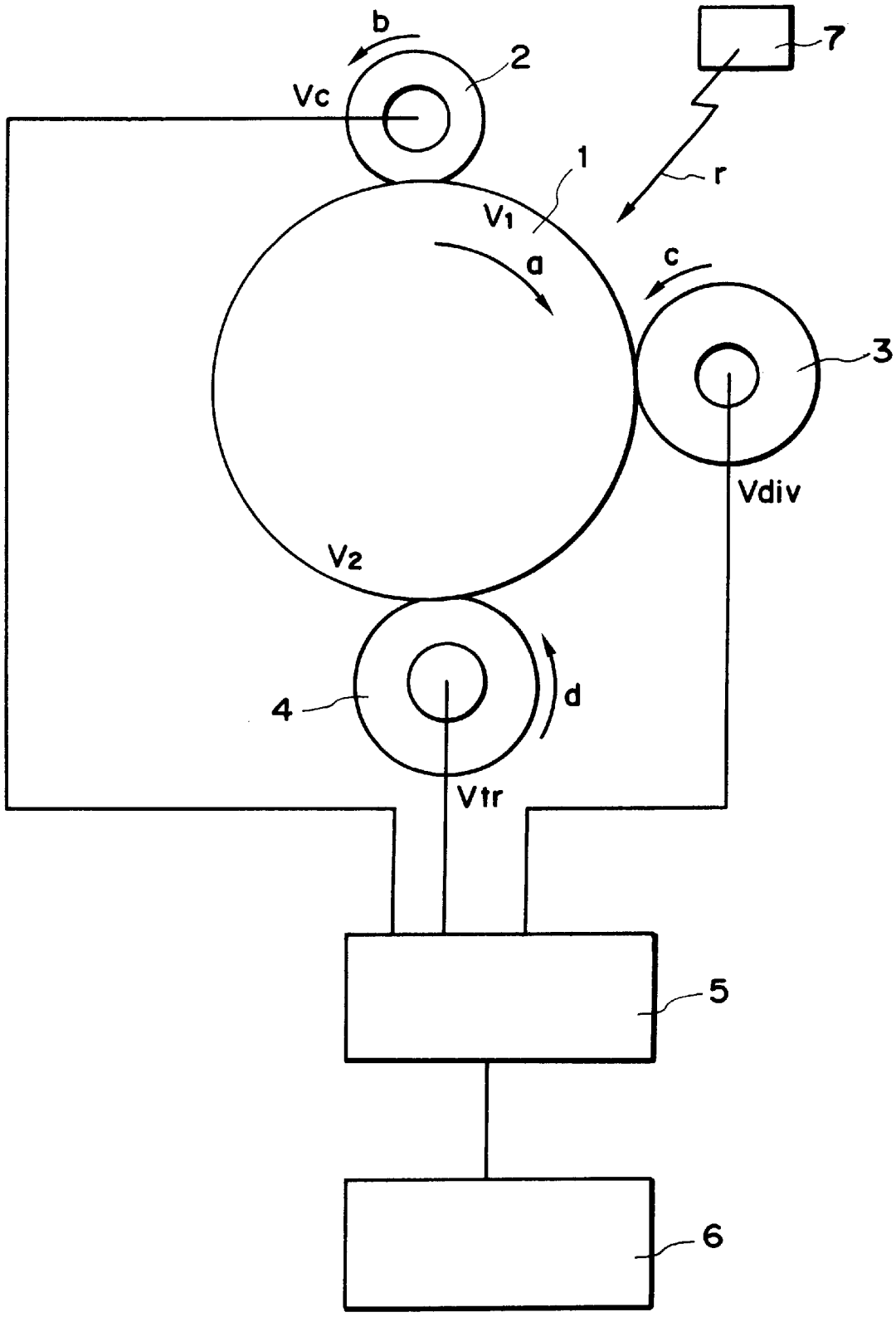
FIG. 1 is a schematic drawing of the image forming apparatus in the first embodiment of the present invention, and depicts the general structure of the essential portion of the apparatus.

Next, the structure of the image forming apparatus in this embodiment will be described with reference to FIG. 1.

The image forming apparatus in this embodiment comprises the photosensitive drum 1, the charge roller 2, the development roller 3, the transfer roller 4, a high voltage power source 5, the controller 6, an exposing mechanism 7, and the like.

The image bearing member in this embodiment is a negatively chargeable photosensitive drum comprising an organic photoconductor layer. Thus, the photosensitive drum 1 may be referred to as "OPC drum 1" in the following description of this embodiment.

The charge roller 2 uniformly charges the peripheral surface of the photosensitive drum 1 to a predetermined potential level by being placed in contact with the photosensitive drum 1. As described previously, in this embodiment, a negatively chargeable OPC drum is employed as the image bearing member, and therefore, the charge roller 2 charges the peripheral surface of the photosensitive drum 1 to negative potential. It is possible to employ a readily available charge roller as the charge roller 2, but in this embodiment, an electrically conductive elastic urethane roller with a volumetric resistivity of approximately $1\times10^6$ ohm.cm is employed.

The exposing mechanism 7 is such a mechanism that forms an electrostatic latent image on the peripheral surface of the photosensitive drum 1 by irradiating the photosensitive drum 1 with optical signals r modulated with imaging data.

The development roller 3 is such a component that is placed in contact with the photosensitive drum 1, and visualizes the electrostatic latent image with the use of toner. It carries, on its peripheral surface, nonmagnetic single component toner, which an unillustrated means coats on the development roller 3 to a predetermined thickness so that the coated toner is charged to a predetermined potential level.

The nonmagnetic signal component toner in this embodiment is composed of spherical toner particles produced by polymerization (hereinafter, "polymer toner"). When this type of toner is used, transfer efficiency is no less than 98%, which is extremely high compared to the transfer efficiency for conventional toner. It is possible to employ toner produced by pulverization, polymer toner composed of nonspherical toner particles, or the like toner, but as has been commonly known, when these toners, the particles of which are nonspherical, are employed, transfer efficiency is rather low (amount of the toner particles which fail to be transferred increases) compared to when the polymer toner composed of spherical toner particles is used.

The image forming apparatus in this embodiment employs a cleanerless system; it is structured so that the toner particles which remain on the photosensitive drum 1 without being transferred onto recording medium are eventually recovered by the development roller 3.

The development roller 3 in this embodiment is an electrically conductive elastic silicone roller with a volumetric resistivity of approximately $1\times10^6$ ohm/cm$^3$. The developing device itself, in which the development roller 3 is placed, is based on the widely known technologies, and therefore, the detailed description thereof will be omitted here.

The transfer roller 4 transfers the toner image on the photosensitive drum 1 onto the front side surface of the recording medium delivered between the photosensitive drum 1 and the transfer roller 4, by applying voltage to the back side of the recording medium, in other words, by electrostatic static force. More specifically, the transfer roller 4 employed in this embodiment is an elastic roller formed of electrically semiconductive EPDM sponge, and has a volumetric resistivity of approximately $1\times10^9$ ohm/cm$^3$. However, the volumetric resistivity of the transfer roller 4 does not need to be limited to $1\times10^9$ ohm/cm$^3$; the transfer roller 4 is usable as long as its volumetric resistivity is in a range of $1\times10^8$–$1\times10^{10}$ ohm/cm$^3$.

The above described photosensitive drum 1, charge roller 2, development roller 3, and transfer roller 4 are rotated in predetermined directions by a main motor (unillustrated) which operates following the instructions from the controller 6. The rotational directions for these rollers or the like are indicated in FIG. 1 by arrow marks a, b, c and d. It should be noted here that even though the transfer roller 4 and the photosensitive drum 1 are placed in contact with each other, there is provided a predetermined difference between their peripheral velocities. More specifically, the transfer roller 4 is rotated approximately 3% faster than the photosensitive drum 1. As will be described later, in this embodiment, this difference in peripheral velocity is used to frictionally charge the residual toner particles on the photosensitive drum 1.

The high voltage power source 5 applies voltage of a specific predetermined magnitude to each of the charge roller 2, the development roller 3, and the transfer roller 4. This embodiment is characterized in that a voltage Vc is applied to the charge roller 2; a voltage Vdiv, to the development roller 3; and a voltage Vtr is applied to the transfer roller 4, during a paper jam recovery sequence. The values of the voltage Vc, Vdiv, and Vtr are set from the standpoint of satisfying the following conditions 1, 2 and 3.

Condition 1: the polarities of the voltage Vc, Vdiv and Vtr are the same as the polarity to which the toner is charged.

Condition 2: the absolute values of the voltages V1 and Vdiv satisfy the following relation: $|V1|>|Vdiv|$.

Condition 3: the absolute values of the voltages V1 and V2 satisfy the following relation: $|V1|>|V2|$.

In the above inequalities, the alphanumeric codes V1 and V2 represent the potential level of the portion of the peripheral surface of the photosensitive drum 1 charged by the voltage Vc, and the potential level of the portion of the peripheral surface of the photosensitive drum charged by the voltage Vtr, respectively.

Since a contact type charging system is employed in this embodiment, there is a requirement that the values of the voltage Vc and Vtr must be greater than the threshold voltage for charging the photosensitive drum 1. In this case, the threshold voltage means the minimum voltage necessary to cause electrical discharge between each roller and the photosensitive drum 1.

In this embodiment, in order to satisfy the conditions given above, the values of these voltages Vc, Vdiv and Vtr are set at −1300 V, −350 V and −2000 V, respectively, so that the values of the V1 and V2 become approximately −700 V and −400 V, respectively.

The controller 6 controls the overall operation of the image forming apparatus. For example, it is given the function of applying the charge roller 2, the development roller 3, and the transfer roller 4, to a different specific predetermined potential level with predetermined different timing by controlling the high voltage power source 5. This embodiment is characterized in that the image forming apparatus is structured so that the residual toner particles on the photosensitive drum 1 are returned to the development roller 3 by controlling the timing with which the predetermined specific voltage is applied to each roller, as well as controlling the level of the voltage applied to each roller, in the paper jam recovery sequence, which will be described later in detail. More specifically, the controller 6 comprises memories for storing control programs and data, a processor which carries out the control programs, and the like. The various data and the like (for example, voltage Vc, Vdiv, Vtr, V1, V2) which become necessary for the controls, which also will be described later, are prestored in the memories of the controller 6.

In addition to the above described devices and components, the image forming apparatus in this embodiment comprises devices and components (for example, fixing apparatus) which are generally found in most electrophotographic image forming apparatuses. Those devices and components also operate in response to the instructions from the controller 6, as do the aforementioned.

The "image bearing member" mentioned in the present invention corresponds to the photosensitive drum 1 in this embodiment. The "charging member" corresponds to the charge roller 2. The "light irradiating means" corresponds to the exposing mechanism 7. The "toner carrying member" corresponds to the development roller 3. The "image transferring member" corresponds to the transfer roller 4. The "voltage applying means" corresponds to the high voltage power source 5. The "controlling means" corresponds to the controller 6. The "surface layer" corresponds to the toner charging layer 4*b* in the second embodiment which will be described later.

Next, the operation of the image forming apparatus in this embodiment will be described.

The following description will be focused upon the primary characteristic of this embodiment, that is, the paper jam recovery sequence carried out to recover the residual toner particles after the occurrence of a paper jam or the like.

As the paper jam occurs, the controller 6 waits until the jammed paper or the like is removed by a user so that the image forming apparatus is enabled to operate again. As soon as the apparatus is enabled to operate, the controller 6 initiates the paper jam recovery sequence to remove the residual toner particles on the photosensitive drum 1. Next, the paper jam recovery sequence will be described.

The controller 6 activates the main motor (unillustrated) to move the photosensitive drum 1, charge roller 2, development roller 3, transfer roller 4, and fixing apparatus (unillustrated). At the same time, it controls the high voltage power source so that the voltage Vc (=−1300 V) is applied to the charge roller 2; the voltage Vdiv (=−350 V), to the development roller 3; and the voltage Vtr (=−2000 V) is applied to the transfer roller 4. As a result, the peripheral surface of the photosensitive drum 1 is charged so that the potential on the downstream side of the transfer roller 4, relative to the rotational direction of the photosensitive drum 1, changes to the V2 (=−700 V), and the potential on the downstream side of the charge roller 2, relative to the rotational direction of the photosensitive drum 1, changes to the V1 (=−400 V).

Obviously, immediately after the occurrence of a paper jam, the residual toner particles resulting from the paper jam are remaining on the region between the development roller 3 and the transfer roller 4 of the peripheral surface of the photosensitive drum 1. As the aforementioned control is executed, the residual toner particles on the peripheral surface of the photosensitive drum 1 are delivered first to the interface between the transfer roller 4 and the photosensitive drum 1 as the photosensitive drum 1 is rotated. Since there is a difference between the peripheral velocities of the transfer roller 4 and the photosensitive drum 1, the photosensitive drum 1 and transfer roller 4 rub against each other. As a result, the residual toner particles having been delivered to this region are rubbed by both the photosensitive drum 1 and the transfer roller 4, being thereby frictionally charged. Further, the surface potential of the photosensitive drum 1, of the region on the immediately downstream side of the transfer roller 4 relative to the rotational direction of the photosensitive drum 1, has changed to the V2. Therefore, in this region, that is, the region on the immediately downstream side of the transfer roller 4, such an electrical field that transfers the negatively charged toner particles from the transfer roller 4 to the peripheral surface of the photosensitive drum 1 has been generated. Consequently, the frictionally charged residual toner particles transfer from the transfer roller 4 onto the peripheral surface of the photosensitive drum 1 (redevelopment). According to the research conducted by the applicants of the present invention, the frictional charging of the toner particles occurs in this region.

As the photosensitive drum 1 rotates further, the residual toner particles having returned to the photosensitive drum 1 reach the nip between the photosensitive drum 1 and the charge roller 2, and passes through it. Since the peripheral surface of the charge roller 2 has been charged to the potential V1 which is higher than the potential V2 to which the peripheral surface of the photosensitive drum 1 has been charged by the transfer roller 4, the residual toner particles on the photosensitive drum 1 do not adhere to the peripheral surface of the charge roller 2; they are repelled by the repulsive electric field.

As the photosensitive drum 1 rotates further, the residual toner particles having returned to the photosensitive drum 1 reaches the nip between the development roller 3 and the photosensitive drum 1. In this nip, such an electric field that satisfies the inequality $|V1|>|Vdiv|$ has been generated, therefore, the residual toner particles on the photosensitive drum 1 are recovered by the development roller 3.

The development voltage (Vdiv) may begin to be applied at the same time as the photosensitive drum 1 begins to be rotated at the beginning of the paper jam recovery sequence. However, it is desirable that the timing for applying the development bias (Vdiv) to the development roller 3 is delayed for a duration equivalent to the time it takes for the peripheral surface of the photosensitive drum 1 to move a distance equivalent to the distance between the charge roller 2 and the development roller 3.

As described above, according to this embodiment, the residual toner particles for which a paper jam is responsible can be effectively recovered. In addition, the residual toner particles are recharged in the interface between the photosensitive drum 1 and the transfer roller 4, eliminating the need for a complicated memory removing means such as a memory erasing means installed in a conventional apparatus. In other words, this embodiment makes the best use of the merits (low cost, weight reduction, and the like) of the cleanerless system.

The polarity of the voltages applied to the rollers 2, 3 and 4 does not need to be limited to negative polarity; it may be selected according to the polarity of a photosensitive drum and toner. For example, when the polarity of a photosensitive drum and toner is positive, positive voltage is applied to each roller.

In this embodiment, a contact type charging system is employed, and therefore, there is a requirement that the voltages Vc and Vtr must be greater than the threshold voltages for charging the photosensitive drum 1. However, it is feasible to provide a charge injection site on the photosensitive drum side to inject charge into the photosensitive drum. In such a case, the values of the voltage Vc and Vtr may be lower than the threshold voltage.

Embodiment 2

The second embodiment is characterized primarily in that in order to charge the residual toner particles more effectively, a transfer roller is provided with a toner charging surface layer chargeable to the polarity opposite to the polarity to which the toner is chargeable. Otherwise, this embodiment is the same as the first embodiment. Thus, the description given below will be focused on the transfer roller.

Figure 2:
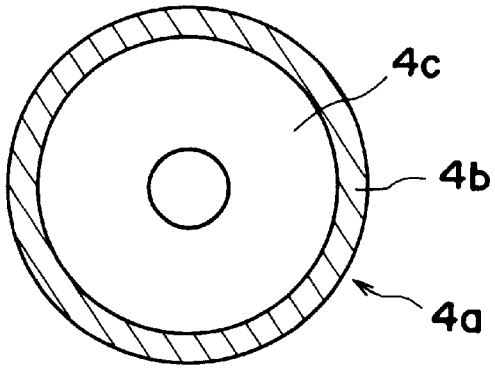
FIG. 2 is a schematic section of the transfer roller in the second embodiment of the present invention, and depicts the structure of the roller.

Referring to FIG. 2, the transfer roller 4*a* in the second embodiment comprises a base layer 4*c* and a toner charging layer 4*b*.

The base layer 4*c* is the same as the one found in the transfer roller 4 in the first embodiment. In other words, the base layer 4*c* is formed of semiconductive EPDM sponge with a volumetric resistivity of approximately $1\times10^9$ ohm.cm.

The toner charging layer 4*b* is provided to increase the amount of charge given to the toner by the friction between the photosensitive drum 1 and the transfer roller 4*a*, and its polarity is opposite to the toner polarity. Since the toner charging layer 4*b* constitutes the surface layer of the transfer roller 4*a*, it is desired to be provided with elasticity. Thus, it occurred to the inventors to form the toner charging layer 4*b* using resin such as elastomer or rubber, and in reality, the toner charging layer 4*b* in this embodiment is formed of compound material composed of polyamide resin and electrically conductive particles (for example, carbon, metallic oxide, and the like) dispersed in the polyamide resin by a proper amount to adjust the volumetric resistivity of the material to approximately $1\times10^9$ ohm/cm$^3$ so that the material becomes semiconductive. In other words, the transfer roller 4*a* in this second embodiment is given the characteristics of a development roller, in addition to the function as a transfer roller. Further, besides polyamide resin, silicone resin, urethane resin, or the like may be employed as the material for the toner charging layer 4*b*, and these resins do not necessarily need to be used alone; they may be used in optional combinations to form the toner charging layer 4*b*. With the employment of the transfer roller 4*a* described above, the performance of the aforementioned interface in terms of charging the charge depleted toner particles is improved, and therefore, the amount of the electrical charge which the residual toner particles receive becomes greater. As a result, the amount of the residual toner particles which adhere to a charge roller in this embodiment further decreases compared to the first embodiment, and also, the performance of the development roller in terms of recovering the toner particles increases.

It is possible to charge the residual toner particles by placing a dielectric roller in contact with the toner particles. When the transfer roller is constituted of a dielectric roller, the electrical conductivity may be small (conductivity has only to be high enough to make the roller semiconductive).

A small amount of fluorinated resin may be mixed in the resin which forms a roller. Such a mixture can improve the toner particle releasing ability of the roller while maintaining the roller surface polarity which is opposite to the toner polarity.

Effects of Embodiments 1 and 2

As described above, according to the preceding two embodiments, the toner particles remaining on the peripheral surface of a photosensitive drum can be returned to a development roller. In addition, a member for erasing memory or the like, which a conventional apparatus requires, is unnecessary.

Embodiment 3

Figure 3:
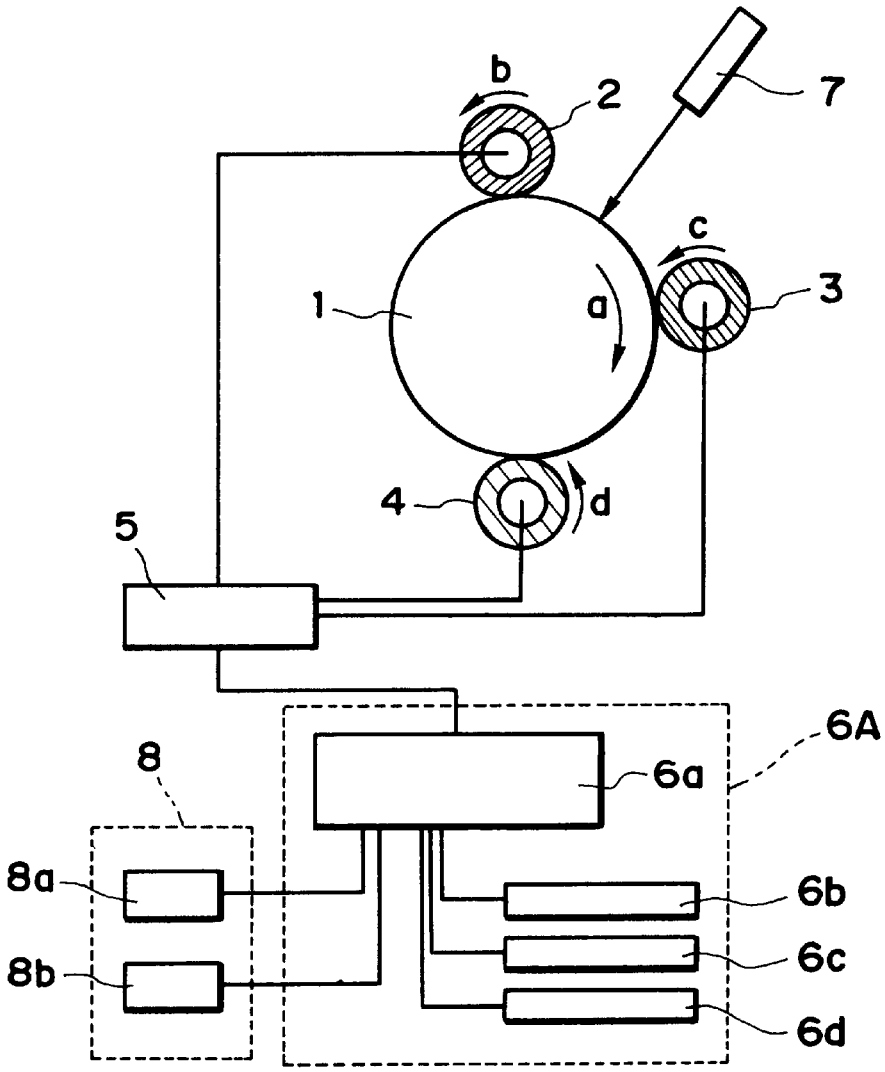
FIG. 3 is a schematic drawing of the image forming apparatus in the third embodiment of the present invention.

FIG. 3 depicts the third embodiment of the present invention. In FIG. 3, the structural components which are the same as those described in the first embodiment will be designated by the same referential codes as those used in the first embodiment.

In FIG. 3, a referential numeral 1 designates a photosensitive drum as an image bearing member. In this third embodiment, it is a negatively chargeable OPC drum. A referential numeral 2 designates a charge roller, which is placed in contact with the OPC drum 1 and uniformly charges the peripheral surface of the OPC drum 1 to a predetermined potential level. In this embodiment, the peripheral surface of the OPC drum 1 is negatively charged. A referential numeral 7 designates an exposing means which forms an electrostatic latent image by irradiating the uniformly charged peripheral surface of the photosensitive drum 1 with an optical image or a beam of light modulated with image signal provided by an unillustrated optical means.

A reference numeral 3 designates a development roller which is placed in contact with the photosensitive drum 1, and visualizes the electrostatic latent image with the use of toner. The development roller 1 carries, on its peripheral surface, nonmagnetic single component toner. The amount of the toner carried by the development roller 3 is adjusted by an unillustrated means to a predetermined amount so that the thickness of the toner layer on the development roller 3 becomes a predetermined one, and also the toner is charged to a predetermined potential level. A referential numeral 4 designates a semiconductive transfer roller with a volumetric resistivity of approximately $10^8$–$10^{10}$ ohm.cm. The transfer roller 4 is placed in contact with the OPC drum 1 while maintaining a difference in peripheral velocity from the OPC drum 1. The transfer roller 4 applies voltage to the back side of a transfer sheet delivered between the OPC drum 1 and the transfer roller 4 to transfer the toner image on the OPC drum 1 onto the front side of the transfer sheet P. The transfer roller 4 is rotated approximately 3% faster than the OPC drum 1.

Reference to FIG. 3, the OPC drum 1, charge roller 2, development roller 3, and transfer roller 4 rotate in the directions indicated by arrow marks a, b, c and d. A referential numeral 5 designates a high voltage power source, which applies voltage of a different value to the charge roller 2, to development roller 3, and to transfer roller 4. An alphanumeric reference 6A designates a controller, which controls the high voltage power source 5 in such a manner that the aforementioned voltage of the predetermined different value is applied to the charge roller 2, to development roller 3, and to transfer roller 4, with predetermined timing.

The controller 6A comprises a CPU, a control section 6*a* with a counter for setting the operational timing for the image forming apparatus; and a ROM section for storing the sequences in which the aforementioned voltages with the predetermined value are applied. The ROM section is constitutes of three sub-sections: a ROM 6*b* for storing a voltage application sequence 1 for a normal operation, a ROM 6*c* for storing a voltage application sequence 2 for restoring the operation of the image forming apparatus after the occurrence of operational errors, and a ROM 6*d* for storing a voltage application sequence 3, different from the sequence 2, also for restoring the operation of the image forming apparatus after the occurrence of operational errors.

A reference numeral 8 designates a means for detecting the condition of the image forming apparatus. It comprises a means 8*a* for detecting the temperature of an unillustrated fixing apparatus, and a sheet sensor 8*b* which detects, with predetermined timing, whether or not a transfer sheet is present in the transfer sheet conveyance path in the image forming apparatus.

Next, the voltage application sequences 1, 2 and 3 stored in the ROMs 6*b*, 6*c* and 6*d*, correspondingly, will be described.

Voltage Application Sequence 1

Figure 4:
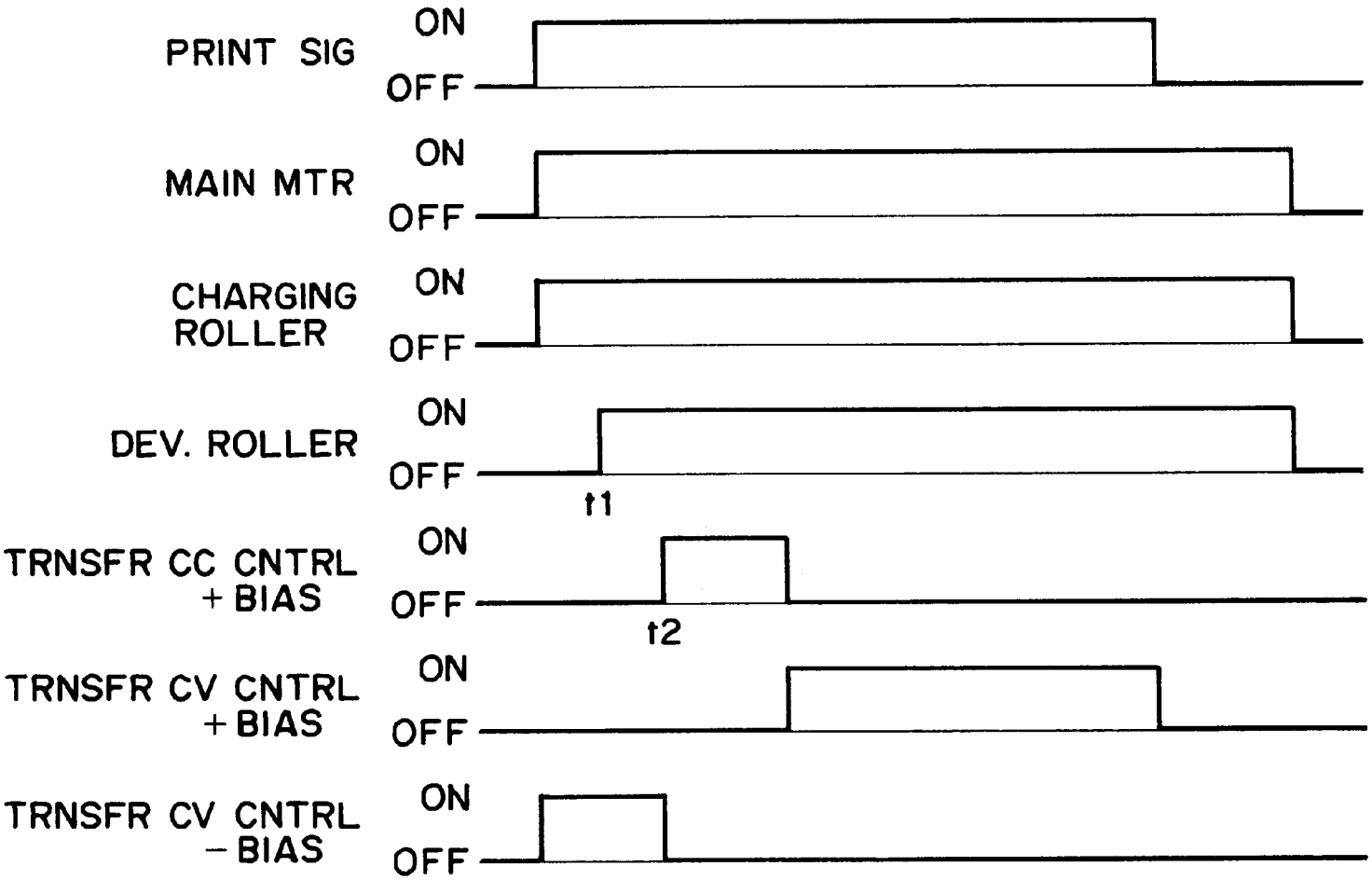
FIG. 4 is a timing chart for the image forming apparatus in the third embodiment of the present invention.
Figure 5:
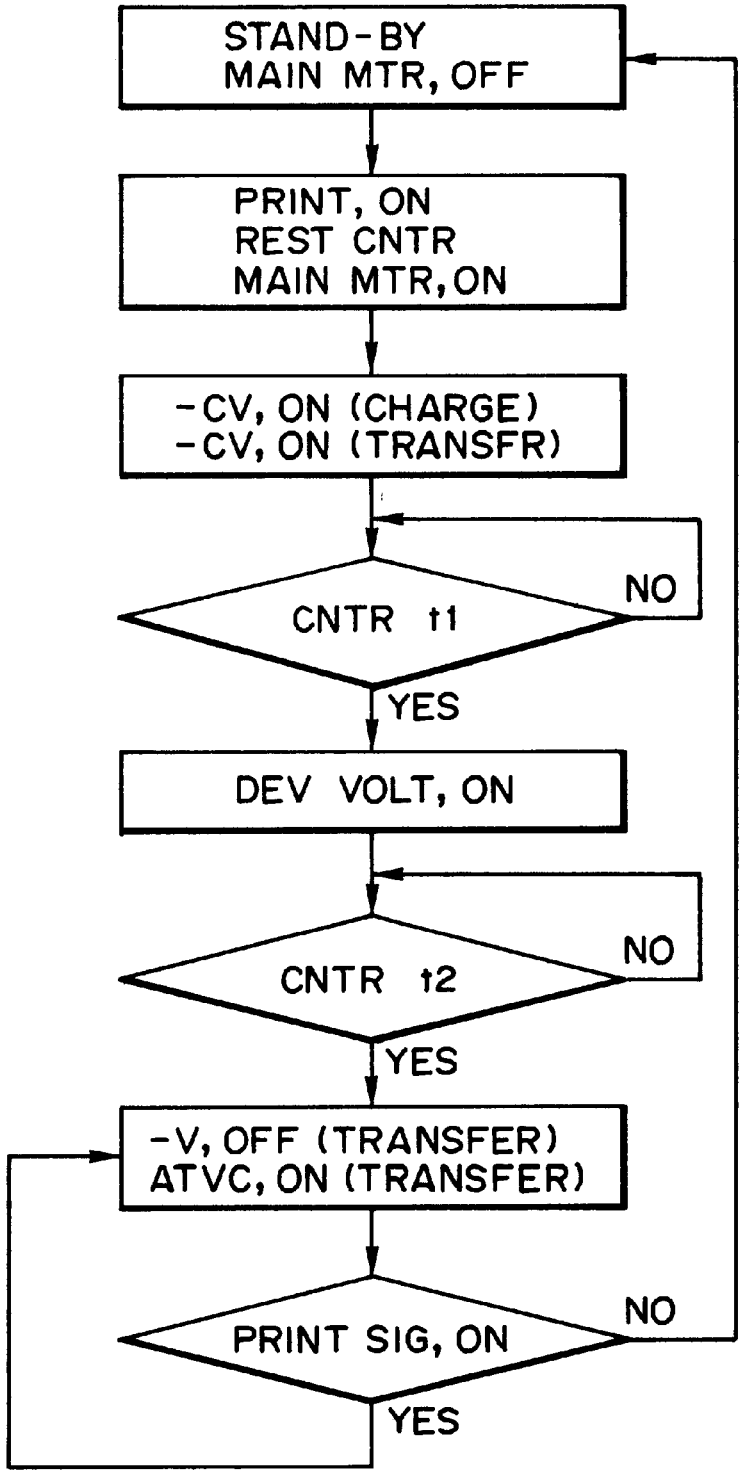
FIG. 5 is an operational flow chart for the image forming apparatus in the third embodiment of the present invention.

The voltage application sequence 1 is an operational sequence carried out to apply voltage to the charge roller 2, development roller 3, and transfer roller 4 while the image forming operation is normally operating. This sequence will be described with reference to FIGS. 4 and 5. Since the normal start-up of the image forming apparatus to the standby point is the same as the one for a conventional image forming apparatus, its description will be omitted here.

As a print signal is inputted while the image forming apparatus is on standby, the control section 6*a* resets the internal counter, and turns on the main motor. Next, the control section 6*a* applies negative voltage to the charge roller 2 and the transfer roller 4. As soon as the counter reaches t1, the control section 6*a* applies negative voltage to the development roller 3, and then, as soon as the counter reaches t2, the control section 6*a* stops applying the negative voltage to the transfer roller 4. In this embodiment, the control section 6 controls the transfer roller 4 following automatic transfer voltage control (ATVC) disclosed in Japanese Laid-Open Patent Application No. 2-123385 or the like.

ATVC makes it possible to provide the transfer roller 4 with an optimum transfer voltage under all conditions, and therefore, makes it possible to maintain the maximum transfer efficiency under all conditions. In comparison, when constant current control is carried out in place of ATVC, the magnitude of the transfer electric field across the image region is reduced as a small size sheet is passed, and therefore, transfer efficiency is reduced, which is disclosed in Japanese Laid-Open Patent Application No. 2-123385 or the like.

On the other hand, under constant current control, transfer efficiency reduces in a low humidity environment, as disclosed also in Japanese Laid-Open Patent Application No. 2-123385 or the like. This is due to the fact that the resistance of the transfer roller 4 is affected by environmental changes. Thus, conventional transfer control limits the performance of a cleanerless image forming apparatus since a cleanerless image forming apparatus requires that transfer efficiency is always high.

On the contrary, ATVC is capable of always maintaining high transfer efficiency, and therefore, it is most suitable for a cleanerless image forming apparatus.

When a printing signal is not inputted after an image forming operation is completed, the image forming apparatus enters the standby state. The aforementioned value t1 is equivalent to the time it takes for the peripheral surface of the photosensitive drum 1 to rotate a distance equivalent to the distance from the interface between the charge roller 2 and the photosensitive drum 1, to the interface between the development roller 3 and photosensitive drum 1, and the value t2 is equivalent to the time it takes for the peripheral surface of the photosensitive drum 1 to rotate a distance equivalent to the distance from the interface between the charge roller 2 and the photosensitive drum 1, to the interface between the transfer roller 4 and the photosensitive drum 1.

Next, the operational sequence carried out to restore the normal operation of the image forming apparatus after the occurrence of operational errors during an image forming operation will be described. This sequence represents the primary characteristic of the present invention. According to the present invention, whether or not errors have occurred in the main assembly of the image forming apparatus is determined by the controller 6 based on the output from the apparatus condition detecting means 8 or the like. In this third embodiment, the controller 6 suspends the ongoing image forming operation, when it determines that the output from the sheet sensor 8*b* is equivalent to a delay jam; the power to the apparatus is unexpectedly cut off; and the like, at the point where it detects the incident.

It is expected that as soon as a user recognizes that the operation of the apparatus main assembly has been temporarily suspended, the user tries to restore the operation of the apparatus main assembly. At this point, the aforementioned sequence for restoring the normal operation of the apparatus main assembly are carried out according to the output from the apparatus condition detecting means 8 and the like. As described above, there are two sequences for restoring the normal operation, and the two sequences are selectively used depending on the output from the apparatus condition detecting means 8.

The voltage application sequence 2 stored in the ROM 6*c* is carried out when the apparatus main assembly is in such a state that an operational error has occurred; the temperature detected by the temperature detecting means 8*a* is higher than a predetermined temperature; and the sheet sensor 8*b* is on. In other words, the voltage application sequence 2 is an operational sequence activated to restore the normal operation when the operation of the apparatus main assembly has been suspended due to causes other than a paper jam or the like (for example, when the power to the apparatus main assembly has been cut off due to an unexpected cause such as power failure). On the other hand, the voltage application sequence 3 stored in the ROM 6*d* is a sequence carried out, regardless of the output of the temperature sensor 8*a*, when the output from the sheet sensor 8*b* is "OFF". In other words, the sequence 3 is such a sequence that is activated to restore the normal operation of the apparatus main assembly when the normal operation of the apparatus main assembly has been interrupted due to a delay jam such as a paper jam. Hereinafter, the voltage application sequences 2 and 3 will be described in detail.

Figure 6:
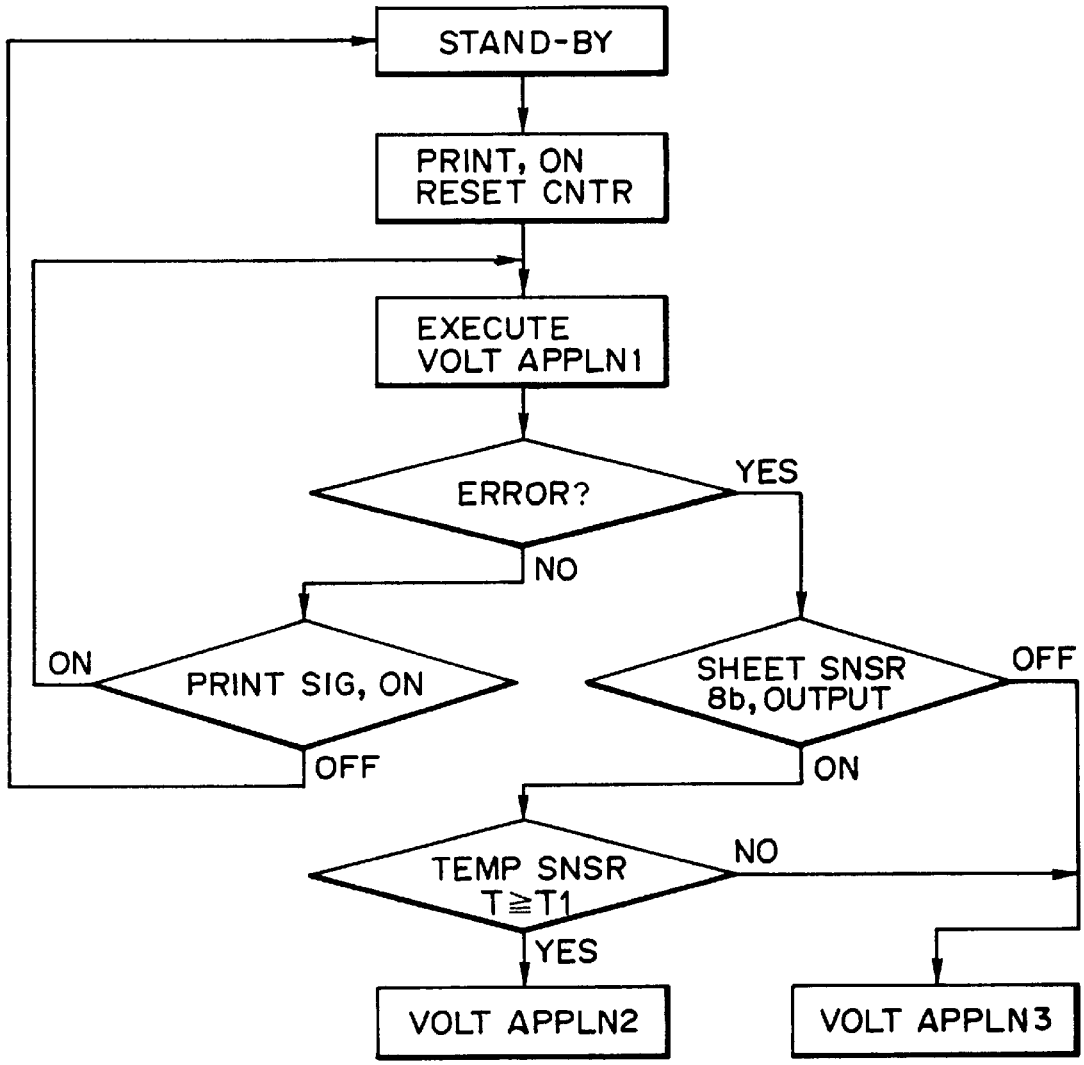
FIG. 6 is an operational flow chart for the image forming apparatus in the third embodiment of the present invention.

Referring to FIG. 6, as the controller 6A detects an error while the apparatus main assembly is in operation, it checks the output from the sheet sensor 8*b*. When the output of the sheet sensor 8*b* is "OFF", and the controller 6A determines that the error is a delay jam, it suspends the apparatus main assembly in a state in which only the voltage application sequence 3 can be carried out.

Figure 7:
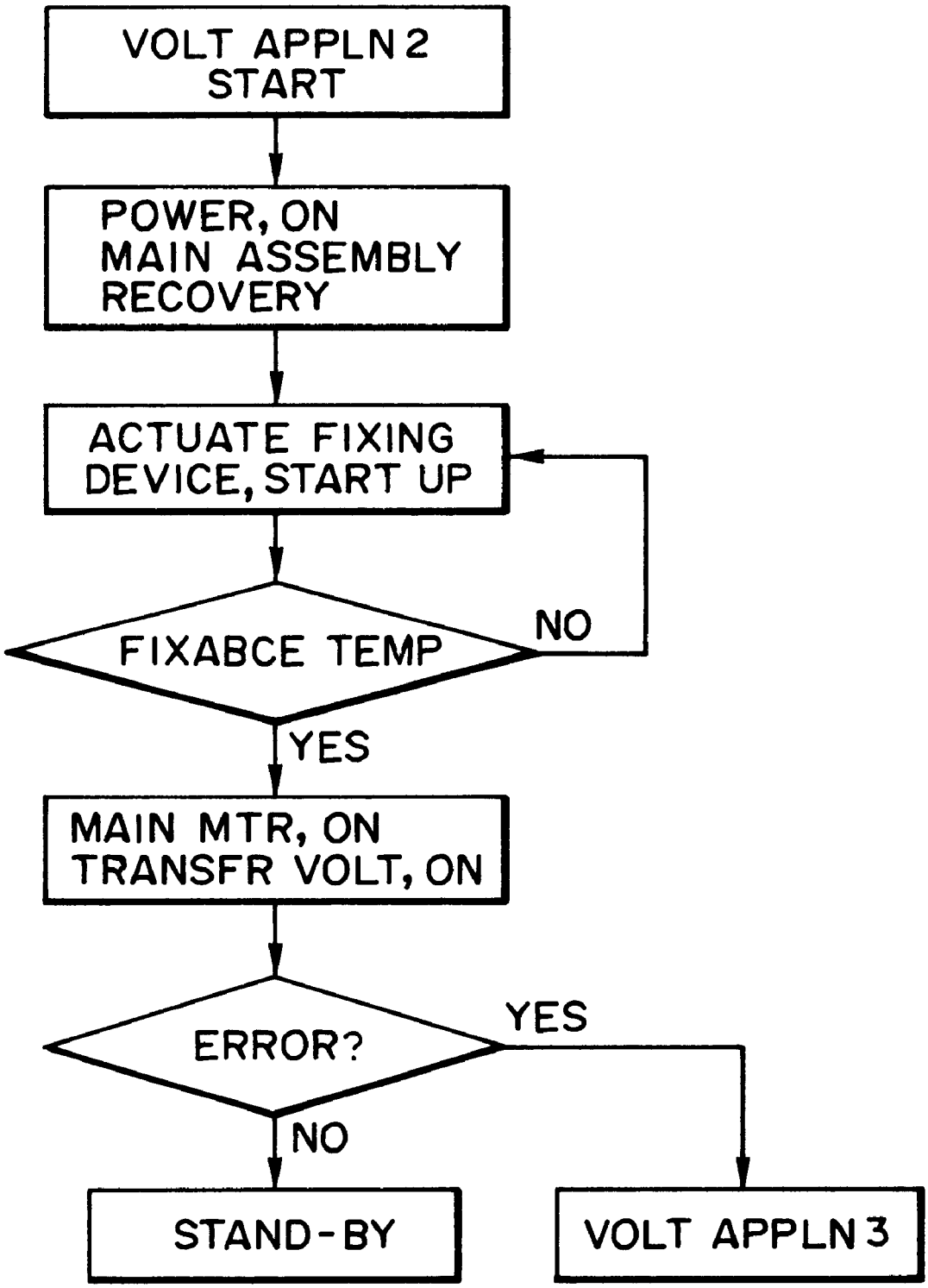
FIG. 7 is an operational flow chart for the image forming apparatus in the third embodiment of the present invention.

When the output of the sheet sensor 8*a* is "ON", and the controller 6A determines that the error is something other than a delay jam, it checks the output of the temperature detecting means 8*a* after the power is restored. At this point, when the output of the temperature detecting means 8*a* indicates that the temperature is higher than a predetermined temperature T1, the controller 6A interrupts the ongoing image forming operation, and immediately carries out the voltage application sequence 2 given in FIG. 7, to restore the apparatus main assembly to the normal condition. On the other hand, when the output of the temperature detecting means 8*a* indicates that the temperature is lower than the predetermined temperature T1, the controller 6A suspends the apparatus main assembly in a state in which only the voltage application sequence 3 can be carried out.

First, the voltage application sequence 2 will be described. The voltage application sequence 2 is carried out by the controller 6 following the sequence given in FIG. 7. As soon as the power is restored, the controller 6A starts the operation for restoring the apparatus main assembly to the normal condition.

To begin with, the controller 6A starts up the fixing apparatus. Then, as soon as the temperature detecting means 8*a* detects that the temperature of the fixing apparatus is in a range in which fixing is possible, the controller 6A starts the main motor to convey the transfer sheets remaining in the apparatus main assembly. At the same time, it turns on the transfer voltage so that the residual toner particles on the peripheral surface of the photosensitive drum 1 are transferred onto the transfer sheets.

If it has not been too long since the occurrence of the error, the residual toner particles on the peripheral surface of the photosensitive drum 1 still hold a sufficient amount of charge, and therefore, they electrostatically transfer onto the surface of the transfer sheet through a transfer process. According to the present invention, the length of the time which has elapsed since the occurrence of the error is determined based on the output from the temperature detecting means of the fixing apparatus.

As soon as an error occurs, the heat source of the fixing apparatus is disabled, and therefore, the output of the temperature detecting means 8*a* gradually declines as time elapses. When the output of the temperature detecting means 8*a* indicates that the temperature is greater than a predetermined temperature T1, it is reasonable to think that the time which has elapsed since the occurrence of the error in the apparatus main assembly is relatively short, and therefore, the residual toner particles on the peripheral surface of the photosensitive drum 1 are still holding a sufficient amount of charge. As is evident from the above description, the actual value of the T1 must be optimally set for each image forming apparatus. For example, the temperature T1 may be set at the so-called "multiple pre-rotation start temperature", "standby temperature", or the like. As described above, the residual toner particles on the peripheral surface of the photosensitive drum 1 can be easily removed by the recovery operation carried out immediately after the occurrence of an error. If the controller 6A determines, while the voltage application sequence 2 is carried out, that an error has occurred, it suspends the ongoing operation, and keeps the apparatus main assembly in a state in which only the voltage application sequence 3 can be carried out.

Next, a case in which the controller 6A carries out the voltage application sequence 3 will be described. Prior to the present invention, when an operational error occurred in the apparatus main assembly, the residual toner particles on the peripheral surface of the photosensitive drum 1 had to be removed by a dedicated cleaning member; there were not other means. Further, even in the case of a cleanerless image forming apparatus, cleaning means such as a memory erasing member or a cleaning roller was necessary, which was explained previously. According to the present invention, however, as long as it is immediately after the occurrence of an error, the residual toner particles on the peripheral surface of the photosensitive drum 1 can be removed without any difficulty. Further, according to the present invention, the removal of the residual toner particles on the peripheral surface of the photosensitive drum 1 is possible even after a substantial amount of time elapses. The reason for this characteristic of the present invention will be given below.

After the elapsing of a substantial length of time since the occurrence of an operational error, the residual toner particles on the peripheral surface of the photosensitive drum 1 are no longer holding electrical charge, and therefore, it is impossible to remove the residual toner particles from the peripheral surface of the photosensitive drum 1 by electrostatically transferring them onto the transfer sheet surface through a transfer process. Thus, in the case of the present invention, once a substantial length of time elapses after the occurrence of an error, the residual toner particles on the peripheral surface of the photosensitive drum 1 are removed based on the following principle, with the condition that a user removes the transfer medium which has been jammed in the apparatus main assembly.

After the removal of the jammed transfer medium by a user, the residual toner particles on the peripheral surface of the photosensitive drum 1 are frictionally charged between the photosensitive drum 1 and the transfer roller 4; the residual toner particles are recharged by driving the photosensitive drum 1, charge roller 2, and development roller 3, transfer roller 4, and the like. At the same time, voltage of negative polarity, that is, the same polarity as the polarity to which the residual toner particles are charged, is applied to the transfer roller 4.

Since the potential of the areas of the peripheral surface of the photosensitive drum 1, on which the residual toner particles are remaining, has attenuated to substantially 0 V, the recharged residual toner particles are redeveloped on the peripheral surface of the photosensitive drum 1. In other words, the residual toner particles are charged to the normal polarity and potential level by putting them through the nip between the transfer roller 4 and photosensitive drum 1.

Thereafter, as long as negative voltage is being applied to the charge roller 2, the charge roller 2 is not contaminated by the residual toner particles. Further, the residual toner particles can be effectively returned to the development roller 3 by recharging the peripheral surface of the photosensitive drum 1 to the normal polarity and potential level while applying development bias (negative voltage) to the development roller 3. The process described above, that is, the voltage application sequence 3 in the third embodiment is given in FIG. 8.

Figure 8:
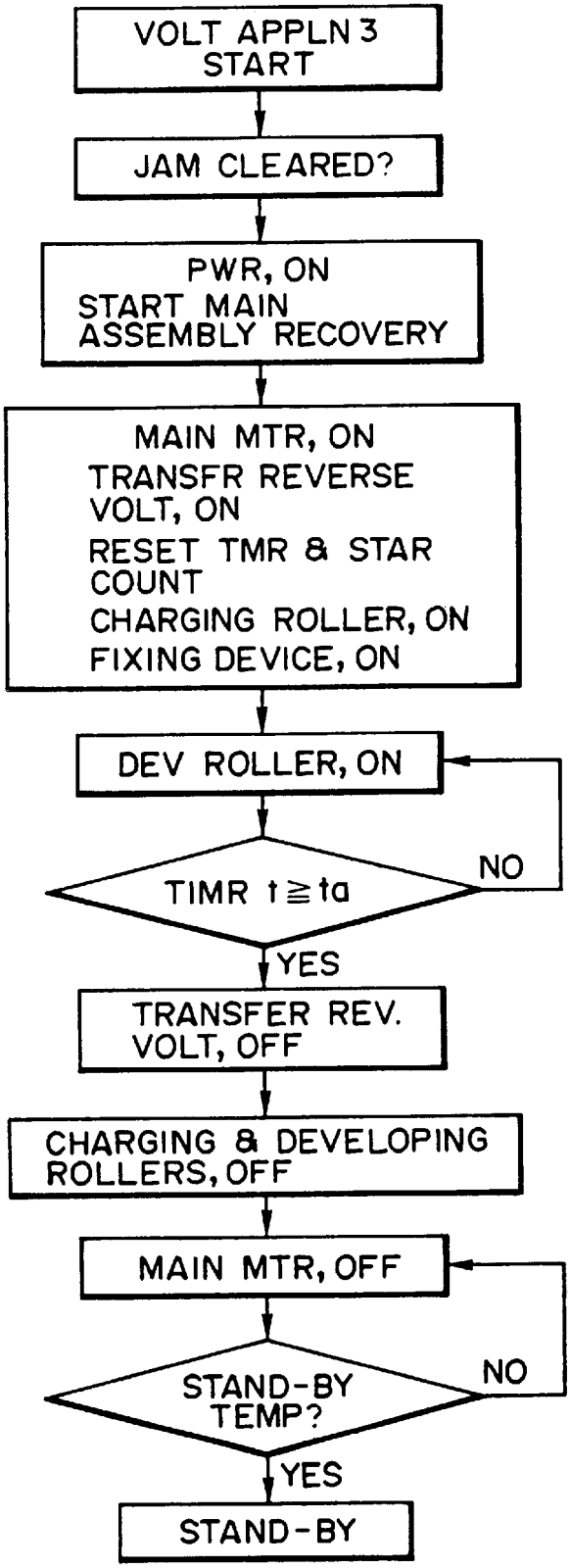
FIG. 8 is an operational flow chart for the image forming apparatus in the third embodiment of the present invention.
Figure 9:
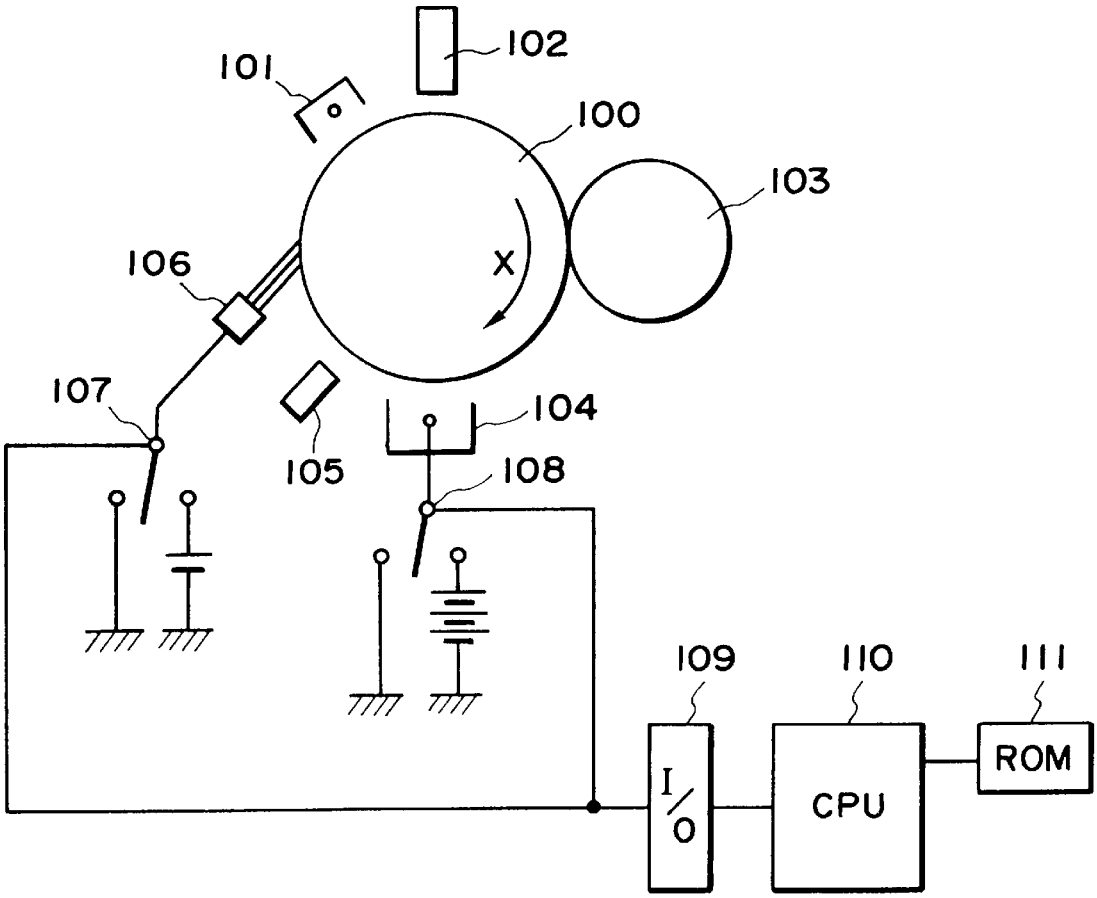
FIG. 9 PRIOR ART
FIG. 9 is a schematic drawing of a typical conventional image forming apparatus, and depicts the general structure thereof.

Referring to FIG. 8, after the jammed transfer medium in the apparatus main assembly is removed by a user, the power source is turned on, and the controller 6A begins a recovery operation following the voltage application sequence 3. After the power is turned on, the controller 6A first resets the counter, and then, turns on the main motor. At the same time, the controller 6A applies predetermined negative voltage to the transfer roller 4, and it also applies negative voltage to the charge roller 2 to charge the peripheral surface of the photosensitive drum 1 to a predetermined potential level. Further, it starts up the fixing apparatus.

As soon as the counter indicates that a predetermined length of time has elapsed, more specifically, after such a length of time that is necessary for the peripheral surface of the photosensitive drum 1 to rotate a distance equivalent to the distance from the interface between the photosensitive drum 1 and the charge roller 2 to the interface between the photosensitive drum 1 and the development roller 3 elapses, the voltage for the development roller 3 is turned on to apply the predetermined development voltage to the development roller 3. This condition is maintained by the controller 6A until the counter indicates the elapsing of a predetermined length ta of time. As soon as the elapsing of the predetermined length ta of time is announced by the counter, the controller 6A first turns off the negative voltage being applied to the transfer roller 4. The length ta has only to be long enough for the peripheral surface of the photosensitive drum 1 to rotate a distance equivalent to the distance from the interface between the photosensitive drum 1 and the transfer roller 4 to the interface between the photosensitive drum 1 and the charge roller 2.

Next, the controller 6A almost simultaneously turns off the voltage being applied to the charge roller 2 and the voltage being applied to the transfer roller 4, and then stops the main motor. Thereafter, the controller 6A starts up the fixing apparatus, and as soon as the temperature detecting means 8*a* detects that the temperature of the fixing apparatus has reached a standby temperature, the controller 6A puts the apparatus main assembly on standby, completing the recovery operation.

As described above, according to this embodiment, the status of the apparatus main assembly is determined based on the output from the condition detecting means, such as the temperature detecting means or the sheet sensor, of the apparatus main assembly, and an optimum voltage application sequence is selected according to the condition of the apparatus main assembly, to apply appropriate voltage to the charge roller, the development roller, and the transfer roller, respectively. Therefore, even in the case of a cleanerless image forming apparatus, the residual toner particles on the peripheral surface of the photosensitive drum can be effectively removed under any condition, preventing the charge roller contamination or the like. In addition, a memory erasing member or the like, which is required in an cleanerless image forming apparatus, prior to the present invention, becomes unnecessary. Thus, a cleanerless image forming apparatus with the simplest structure can be realized; the object of the present invention can be accomplished.

Embodiment 4

Next, the fourth embodiment of the present invention will be described.

In Embodiment 4, in order to increase the amount of the charge given to the toner particles by the friction between the photosensitive drum 1 and the transfer roller 4, which was described in Embodiment 3, the transfer roller 4 was provided with a toner charging layer, which was chargeable to the polarity opposite to the toner polarity, and constituted the outermost layer of the transfer roller 4. This toner charging layer was composed of polyamide resin, and particles of electrically conductive material such as carbon or metallic oxide dispersed in the resin by an appropriate amount to render the layer semiconductive, that is, to adjust the volumetric resistivity of the layer to approximately $10^9$ ohm/cm$^3$.

In other words, the transfer roller 4 in the fourth embodiment is given the characteristics of a development roller, in addition to the function as a transfer roller. As for the material for the toner charging layer, silicone resin, urethane resin, or the like may be employed in place of polyamide resin. With the above arrangement, the performance of the aforementioned interface in terms of charging the charge depleted toner particles is improved, and therefore, the amount of the charge which the toner particles receive becomes greater. As a result, the amount of the toner particles which adhere to the charge roller in this embodiment further decreases compared to the third embodiment, and also, the performance of the development roller in terms of recovering the toner particles increases.

Effects of Embodiments 3 and 4

As described above, according to the present invention, a cleanerless image forming apparatus is controlled with the use of an optimum voltage application sequence among a plurality of voltage application sequences which do not require a memory erasing member such as an electrically conductive brush or a charge removal lamp, and an operational error such as a paper jam can be efficiently rectified by carrying out one of the voltage application sequences; the toner particles remaining on the peripheral surface of a photosensitive member are efficiently returned to a developing means without need for a dedicated cleaning means. Therefore, the high transfer efficiency can be maintained not only in a normal image forming process, but also in an image forming process after the occurrence of an operational error. Thus, it is possible to always form images of desirable quality, including immediately after the occurrence of an operational error.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member having a photoelectric property;

a charging member for charging a surface of said image bearing member while contacting thereto with a predetermined voltage applied to said charging member;

exposure means for exposing the surface of said image bearing member charged by said charging member to form an electrostatic latent image;

a toner carrying member contacted to said image bearing member with a predetermined voltage applied to said toner carrying member to visualize the electrostatic latent image into a toner image with toner carried thereon;

an image transfer member for urging a transfer material to contact the transfer material to said image bearing member with a predetermined voltage applied to said image transfer member to transfer the toner image onto the transfer material;

means for applying the predetermined voltages to said charging member, said toner carrying member and said image transfer member; and control means for controlling said voltage applying means, said control means being operable in an operation mode for applying a predetermined voltage Vc to said charging member, a predetermined voltage Vdiv to said toner carrying member and a predetermined voltage Vtr to said image transfer member, with the following satisfied:

(1) Vc, Vdiv and Vtr have polarities the same as that of the toner;

(2) $|V1| \geqq |Vdiv|$, where V1 is a surface potential of said image bearing member charged by said charging member; and (3) $|V1| > |V2|$, where V2 is a surface potential of said image bearing member charged by voltage Vtr.

2. An apparatus according to claim 1, wherein the operation mode is carried out when malfunction occurs during image forming operation of said image forming apparatus.

3. An apparatus according to claim 2, wherein |Vc| and |Vtr| are larger than a charge starting voltage.

4. An apparatus according to claim 3, wherein said image transfer member is provided with a surface layer having a charging polarity opposite that of the toner.

5. An apparatus according to claim 2, wherein said image transfer member is provided with a surface layer having a charging polarity opposite that of the toner.

6. An apparatus according to claim 1, wherein |Vc| and |Vtr| are larger than a charge starting voltage.

7. An apparatus according to claim 6, wherein said image transfer member is provided with a surface layer having a charging polarity opposite that of the toner.

8. An apparatus according to claim 1, wherein said image transfer member is provided with a surface layer having a charging polarity opposite that of the toner.

9. An apparatus according to any one of claims 4–5, or 7–8, wherein the surface layer is semiconductive.

10. An apparatus according to claim 9, wherein the surface layer comprises at least one of a polyamide resin, a silicone resin and a urethane resin.

11. An apparatus according to claim 10, wherein the surface layer has a volume resistivity of not more than $1\times10^{11}$ ohm-cm.

12. An apparatus according to claim 10, wherein the following is satisfied:

$S_b \geqq S_a$, where $S_a$ is a moving speed of a surface of said image bearing member and $S_b$ is a moving speed of a surface of said image transfer member.

13. An apparatus according to claim 10, wherein a peripheral speed $V_a$ of said image bearing member and a peripheral speed $V_b$ of said image transfer member satisfy $V_b \geqq V_a$.

14. An apparatus according to claim 9, wherein the surface layer has a volume resistivity of not more than $1\times10^{11}$ ohm-cm.

15. An apparatus according to claim 9, wherein the following is satisfied:

$S_b \geqq S_a$, where $S_a$ is a moving speed of a surface of said image bearing member and $S_b$ is a moving speed of a surface of said image transfer member.

16. An apparatus according to claim 9, wherein a peripheral speed $V_a$ of said image bearing member and a peripheral speed $V_b$ of said image transfer member satisfy $V_b \geqq V_a$.

17. An apparatus according to any one of claims 4–5 or 7–8, wherein the surface layer comprises at least one of a polyamide resin, a silicone resin and a urethane resin.

18. An apparatus according to claim 17, wherein the surface layer has a volume resistivity of not more than $1\times10^{11}$ ohm-cm.

19. An apparatus according to claim 17, wherein the following is satisfied:

$S_b \geqq S_a$, where $S_a$ is a moving speed of a surface of said image bearing member and $S_b$ is a moving speed of a surface of said image transfer member.

20. An apparatus according to claim 17, wherein a peripheral speed $V_a$ of said image bearing member and a peripheral speed $V_b$ of said image transfer member satisfy $V_b \geqq V_a$.

21. An apparatus according to any one of claims 4–5 or 7–8, wherein the surface layer has a volume resistivity of not more than $1\times10^{11}$ ohm-cm.

22. An apparatus according to any one of claims 1–8, wherein the following is satisfied:

$S_b \geqq S_a$, where $S_a$ is a moving speed of a surface of said image bearing member and $S_b$ is a moving speed of a surface of said image transfer member.

23. An apparatus according to any one of claims 1–8, wherein a peripheral speed $V_a$ of said image bearing member and a peripheral speed $V_b$ of said image transfer member satisfy $V_b \geqq V_a$.

24. An apparatus according to claim 1, wherein peripheral speeds of said image bearing member and said image transfer member are different from each other when image transfer operation is carried out.

25. An image forming apparatus comprising:

an image bearing member;

a charging member for uniformly charging a surface of said image bearing member while contacting thereto with a predetermined voltage;

developing means for visualizing the electrostatic latent image into a toner image with toner;

an image transfer means for transferring the toner image onto a transfer material;

voltage applying means for applying the predetermined voltages to said charging member, said developing means and said image transfer means;

control means for controlling said voltage applying means; and fixing means for heat-fixing the toner image onto the transfer material;

wherein said control means is operable with an operational sequence which is selected from a plurality of operational sequences on the basis of an output of detecting means for detecting a state of image forming process, and wherein said detecting means detects a temperature of said fixing means.

26. An apparatus according to claim 25, wherein one of the operational sequences is executed when a malfunction occurs during an image forming process operation of said image forming apparatus, and effects a jam recovery operation wherein the image transfer means is supplied with a voltage having a same polarity as the toner on the basis of the output of said detecting means.

27. An apparatus according to claim 25, wherein one of the operational sequences is executed when a malfunction occurs during an image forming process operation of said image forming apparatus, and effects a jam recovery operation wherein the image transfer means is supplied with a voltage having a polarity opposite that of the toner on the basis of the output of said detecting means.

28. An apparatus according to claim 25, wherein one of the operational sequences is executed under a normal condition and effects a constant current control or constant voltage control of said image transfer means when a non-image forming area of said image bearing member is in a zone where said image bearing member and said image transfer means are contacted to each other and during which a voltage or a current is detected, and effects a constant voltage control of said image transfer means when an image forming area of said image bearing member is in the zone with a value determined on the basis of the voltage or current thus detected.

29. An image forming apparatus comprising:

an image bearing member;

developing means for forming a toner image by developing an electrostatic image formed on said image bearing member with toner at a developing position, said developing means being capable of collecting residual toner from said image bearing member;

a transfer member, contacted to said image bearing member, for transferring the toner image onto the transfer material passing between said image bearing member and said transfer member; and control means for effecting a jam recovery sequence after a jammed transfer material is removed and before start of image forming operation, wherein in a jam recovery sequence operation effected by said control means, toner passing through a contact portion between said transfer member and said image bearing member is charged to a regular charging polarity, and an electric field is formed at the contact portion in a direction of moving the regular-charge toner charged to the regular charging polarity from the transfer member toward said image bearing member, and wherein in said jam recovery sequence, an electric field is formed at said developing position in a direction of moving the regular-charge toner from said image bearing member to said developing means.

30. An apparatus according to claim 29, further comprising a charging member contactable to said image bearing member to charge said image bearing member, for formation of the electrostatic image, wherein when the electrostatic image is formed and in the jam recovery sequence operation, said charging member is supplied with a voltage having the same polarity as the regular-charge toner.

31. An apparatus according to claim 29, wherein in said jam recovery sequence operation, said transfer member is supplied with a voltage not less than a voltage at which discharge starts to occur between said image bearing member and said transfer member.

32. An apparatus according to claim 29, wherein said developing means is supplied with a voltage of the same polarity as the regular-charge toner when said developing means operates for development and in said jam recovery sequence operation.

33. An apparatus according to claim 29, wherein in said jam recovery sequence, the toner is triboelectrically charged to the regular charging polarity when the toner passes through said contact portion.

34. An apparatus according to claim 33, wherein said transfer member is provided with a surface layer effective to triboelectrically charge the toner to the regular polarity.

35. An apparatus according to claim 33, wherein a moving speed of a surface of said transfer member at the contact portion is larger than that of a surface of said image bearing member in said jam recovery sequence operation.

36. An image forming apparatus comprising:

an image bearing member;

developing means for forming a toner image by developing an electrostatic image formed on said image bearing member with toner at a developing position;

transferring means for effecting an image transfer operation for transferring the toner image from said image bearing member onto a transfer material at an image transfer position;

fixing means for heat fixing the toner image on the transfer material;

temperature detecting means for detecting a temperature of said fixing means;

transfer material detecting means for detecting a jam of the transfer material in a transfer material feeding path; and control means for effecting, in the case that an electric power supply is shut off without said transfer material detecting means detecting the jam during an image forming operation of said apparatus and then the electric power is resumed, the image transfer operation onto a transfer material which stays in the transfer material feeding path upstream of the image transfer position with respect to a feeding direction of the transfer material when the temperature detected by said temperature detecting means is higher than a predetermined temperature.

37. An apparatus according to claim 36, wherein said transferring means is provided with a transfer member contacted to said image bearing member, and said transfer member transfers the toner image passing between said image bearing member and said transfer member, wherein in a jam recovery sequence operation effected by said control means, toner passing through a contact portion between said transfer member and said image bearing member is charged to a regular charging polarity, and an electric field is formed at the contact portion in a direction of moving the toner charged to the regular polarity from the transfer member toward said image bearing member, and wherein in said jam recovery sequence operation, an electric field is formed at said developing position in a direction of moving the regular-charge toner from said image bearing member to said developing means.

38. An apparatus according to claim 37, further comprising a charging member contactable to said image bearing member to charge said image bearing member, for formation of the electrostatic image, wherein when the electrostatic image is formed and in the jam recovery sequence operation, said charging member is supplied with a voltage having the same polarity as the regular-charge toner.

39. An apparatus according to claim 37, wherein in said jam recovery sequence operation, said transfer member is supplied with a voltage not less than a voltage at which discharge starts to occur between said image bearing member and said transfer member.

40. An apparatus according to claim 37, wherein said developing means is supplied with a voltage of the same polarity as the regular-charge toner when said developing means operates for development and in said jam recovery sequence operation.

41. An apparatus according to claim 37, wherein in said jam recovery sequence operation, the toner is triboelectrically charged to the regular charging polarity when the toner passes through said contact portion.

42. An apparatus according to claim 41, wherein said transfer member is provided with a surface layer effective to triboelectrically charge the toner to the regular polarity.

43. An apparatus according to claim 41, wherein a moving speed of a surface of said transfer member at the contact portion is larger than that of a surface of said image bearing member in said jam recovery sequence operation.

44. An apparatus according to claim 36, wherein said control means executes a jam recovery sequence operation, after said transfer material detecting means detects the jam and before said apparatus is placed into stand-by state.

* * * * *